US006443847B1

(12) United States Patent
van Asch et al.

(10) Patent No.: US 6,443,847 B1
(45) Date of Patent: Sep. 3, 2002

(54) RECREATIONAL APPARATUS

(75) Inventors: Paul Henry Drury van Asch, Queenstown; Arthur Edward Tyndall, Christchurch, both of (NZ)

(73) Assignee: Fun Innovators NZ Limited, Aukland (NZ)

( * ) Notice: Subject to any disclaimer, the term of this patent is extended or adjusted under 35 U.S.C. 154(b) by 0 days.

(21) Appl. No.: 09/720,897

(22) PCT Filed: Jul. 1, 1999

(86) PCT No.: PCT/NZ99/00100

§ 371 (c)(1),
(2), (4) Date: Jan. 2, 2001

(87) PCT Pub. No.: WO00/01455

PCT Pub. Date: Jan. 13, 2000

(30) Foreign Application Priority Data

Jul. 3, 1998 (NZ) ..... 330873

(51) Int. Cl.[7] ..... A63G 31/04
(52) U.S. Cl. ..... 472/50; 472/49; 472/118
(58) Field of Search ..... 472/49, 50, 135, 472/136, 137, 118

(56) References Cited

U.S. PATENT DOCUMENTS

| | | | | |
|---|---|---|---|---|
| 3,827,368 A | | 8/1974 | Garnier | 104/112 |
| 4,280,411 A | | 7/1981 | Katayose et al. | 104/112 |
| 5,081,932 A | | 1/1992 | Hofmann | 104/112 |
| 5,094,448 A | * | 3/1992 | Hackett | 472/136 |
| 5,427,576 A | | 6/1995 | Pfeiffer | 472/136 |
| 5,570,638 A | | 11/1996 | Egli et al. | 104/173.1 |
| 5,782,699 A | * | 7/1998 | Harrap | 472/118 |

FOREIGN PATENT DOCUMENTS

| | | |
|---|---|---|
| WO | 92/19325 | 11/1992 |

* cited by examiner

*Primary Examiner*—Kien T. Nguyen
(74) *Attorney, Agent, or Firm*—Wallenstein & Wagner, Ltd.

(57) ABSTRACT

Bungy jumping apparatus which includes one or more cables (5), means for securing the cable or cables (5) above a jump cavity (2) so as to extend across the jump cavity, a jumping platform (6) supported on one of the cables (5) and securable in a predetermined position on the cable, a bungy securable to the jumping platform (6), and transporting means for carrying jumpers from one edge of the jump cavity (2) to the jumping platform (6) along the cable (5).

58 Claims, 7 Drawing Sheets

RECREATIONAL APPARATUS

TECHNICAL FIELD

The present invention relates to apparatus for bungy jumping.

BACKGROUND ART

The recreational activity of bungy jumping is well-known:—a jumper is secured by a harness or by an ankle tether to one end of a bungy, the other end of which is secured to a jumping platform or other strong point. The original bungys were vines, but modern bungys are heavy multiple strand elastic cords or elastic straps.

Bungy jumping usually takes place from bridges or from purpose built jumping platforms which extend outwards from one side of a natural or man made cavity such as a river gorge or a railway or road cutting. As used herein, the term "jump cavity" means any natural or man-made cavity of suitable dimensions (both of height and width) for bungy jumping.

Bridges and jumping platforms of necessity are permanent fixtures and thus limit the locations where bungy jumping is possible. It is also known to carry out bungy jumps from helicopters. Whilst this can be done at any location, the high cost of positioning helicopters is a limiting factor, and also the accident risk with jumping from a helicopter is higher than with conventional bungy jumping.

DISCLOSURES OF INVENTION

It is therefore an object of the present invention to provide apparatus for bungy jumping which can be installed and dismantled relatively easily and which therefore may be used at a much wider range of different locations, whilst providing bungy jumping facilities in the same price range and with similar safety factors to conventional bungy jumping from bridges or fixed jumping platforms.

The present invention makes it possible to utilize for bungy jumping a very wide range of different jump cavities e.g. natural cavities such as river gorges or valleys between hills, man-made cavities such as railway cuttings or spaces between adjacent high buildings, or cavities which are part natural and part man-made. The jump cavities usually would be outdoors, but could be indoors e.g. in the interior of a large building. It also would be possible to create a jump cavity between and below two tethered balloons.

The present invention provides bungy jumping apparatus, said apparatus including: one or more cables, said cables being mutually substantially parallel if two or more cables are present; means for securing the or each of said cables above a jump cavity (as hereinbefore defined) such that one cable or two or more cables in combination extends across said cavity; a jumping platform supported upon at least one of said cables; said jumping platform being securable in a predetermined position on said cable; at least one bungy securable to said jumping platform; and transporting means for transporting jumpers from adjacent the edge of the jump cavity to a selected position along the or each said cable.

The edges of the jump cavity may be level with each other in a horizontal plane, but need not be:—one edge may be higher than the other.

The jumping platform may be fixed on the cable or may be mobile; if the jumping platform is mobile, it may also be used as the means for transporting jumpers to said selected position. If the jumping platform is fixed in position on the cable, a separate transporting means is used to ferry jumpers along the cable out to the jumping platform. This separate transporting means preferably is a gondola, but may be for example, a walkway supported from the cable, or a boson's chair or a flying fox. More than one transporting means may be used—jumpers may be transported to the jumping platform from each side of the jump cavity.

The transporting means may be supported on the primary cable (i.e. the same cable as the jumping platform), and may be independently powered to move along that cable. Preferably, the transporting means is moved by a second, drive cable in the form of an endless loop. The drive cable may extend right across the jump cavity or may extend from one side of the jump cavity to a point part way along the primary cable, at or beyond the position of the jumping platform.

As used herein, the terms 'primary cable' and 'drive cable', although used in the singular, also include multiple parallel primary cables and multiple parallel drive cables, respectively.

Preferably, the drive cable is driven in known manner by a driving bull wheel mounted adjacent one side of the jump cavity. At the other end of the drive cable run, the drive cable passes around a second, non-driven, bull wheel. If the drive cable extends right across the jump cavity, the second bull wheel is mounted at the other side of the jump cavity to the driving bull wheel. If the drive cable extends only to a point part way along the primary cable, the second bull wheel is supported from the primary cable, and may be counter weighted by a pendulum counter weight for stability. Alternatively, the primary cable may be omitted altogether and the second bull wheel supported by a further cable extending from said other side of the jump cavity to the second bull wheel.

In another embodiment, the transporting means is supported upon the drive cable, and may be used in combination with a fixed jumping platform mounted upon the primary cable or, the transporting means may be used also as a jumping platform. A counterweight to the transporting means also may be mounted on the drive cable, in opposition to the transport means. Most preferably, two transporting means are used, mounted upon the drive cable and spaced apart on the drive cable so that both may be used alternately as jumping platforms:—the first transporting means is moved adjacent the edge of the jump cavity and loaded with jumpers and then moved over the jump cavity for the jumpers to jump, whilst the second transporting means is moved adjacent the edge of the jump cavity to be loaded with jumpers. If the drive cable extends right across the jump cavity and two transporting means are used, then it would be possible to load one transporting means at one edge of the jump cavity and the other transporting means at the other edge of the jump cavity.

BRIEF DESCRIPTION OF DRAWINGS

By way of example only, preferred embodiments of the present invention are described in detail with reference to the accompanying drawings in which.

BEST MODES OF CARRYING OUT INVENTION

Figure 1:
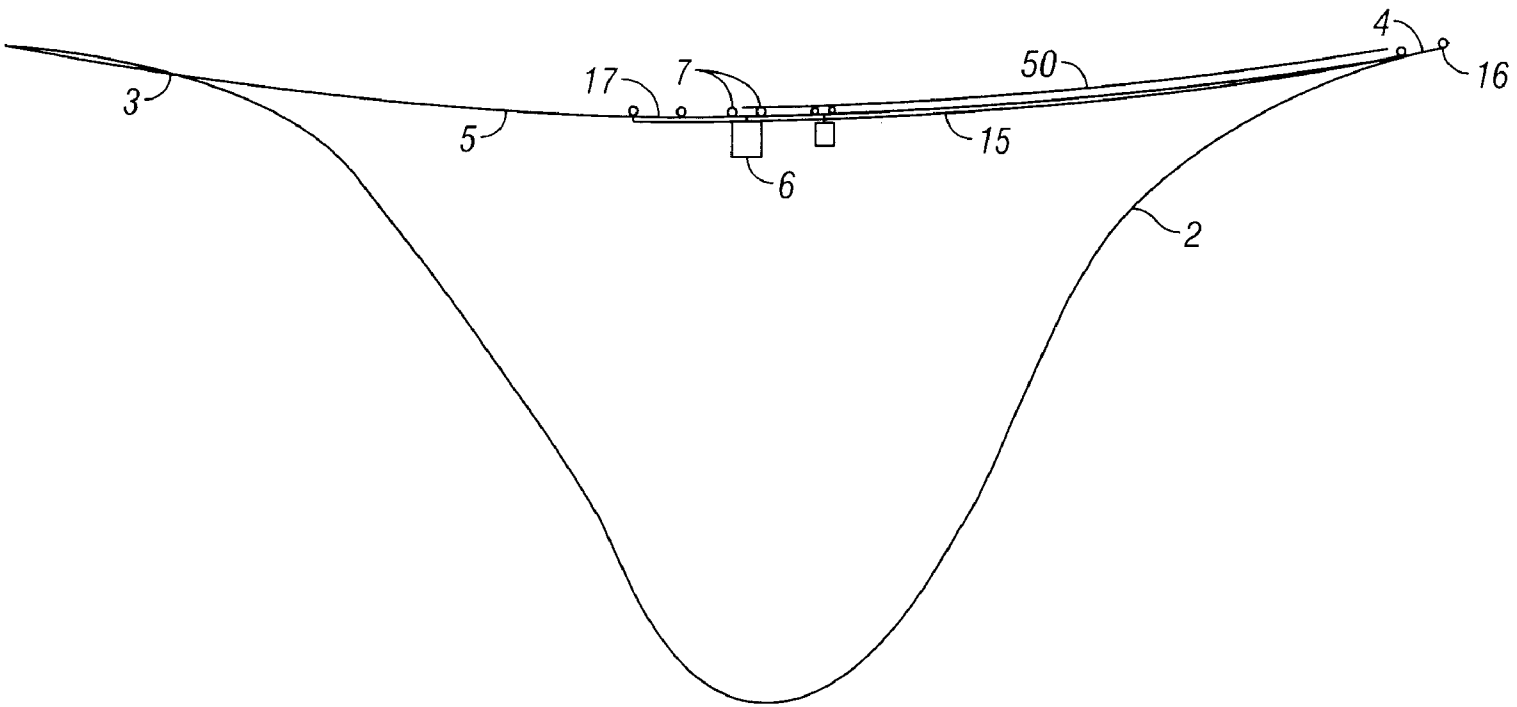
FIG. 1 shows in diagrammatic form a cross-section through a jump cavity and the apparatus of a first embodiment of the present invention.
Figure 2:
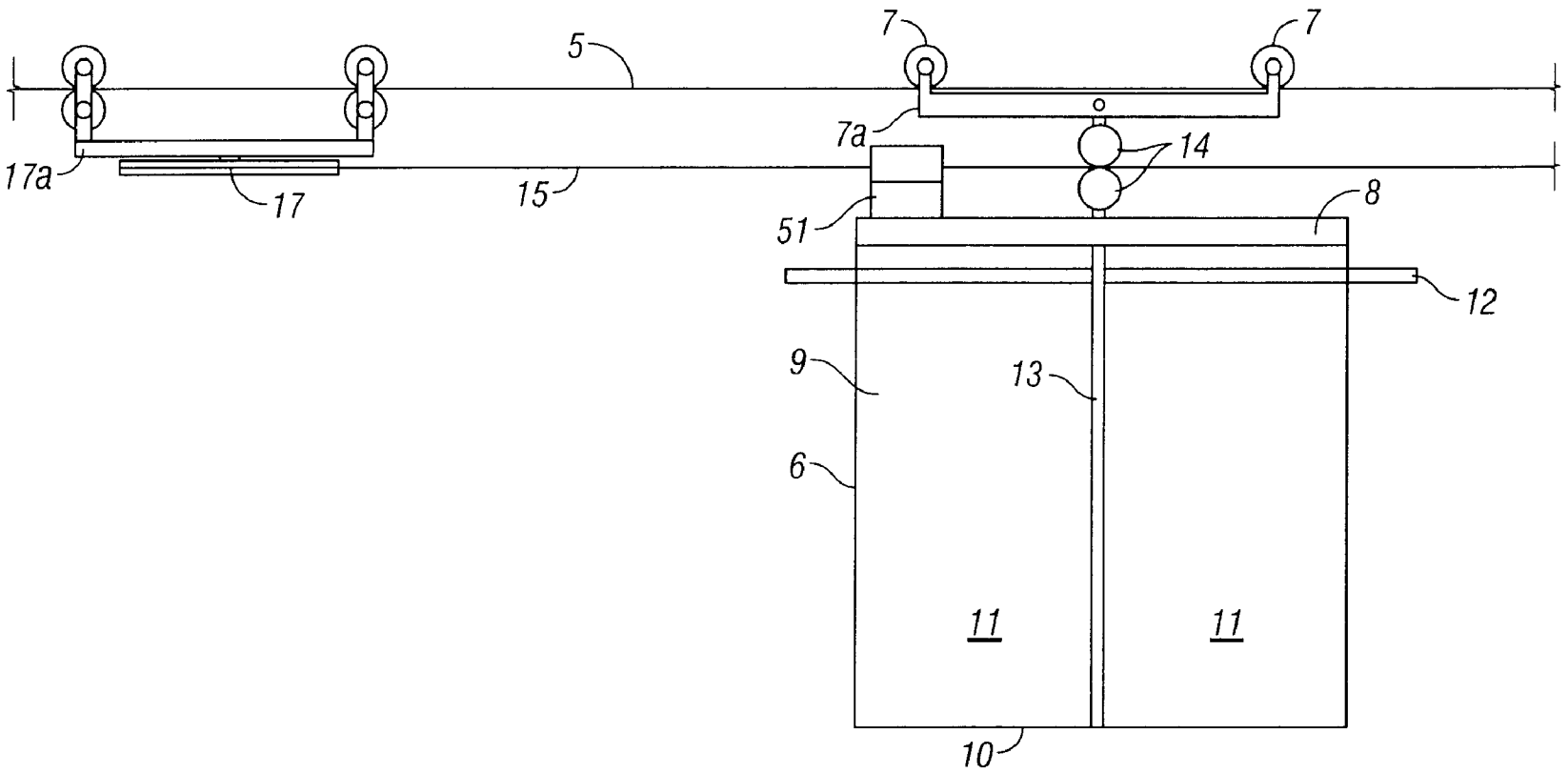
FIG. 2 shows a side view of part of the apparatus of FIG. 1, on a larger scale.
Figure 3:
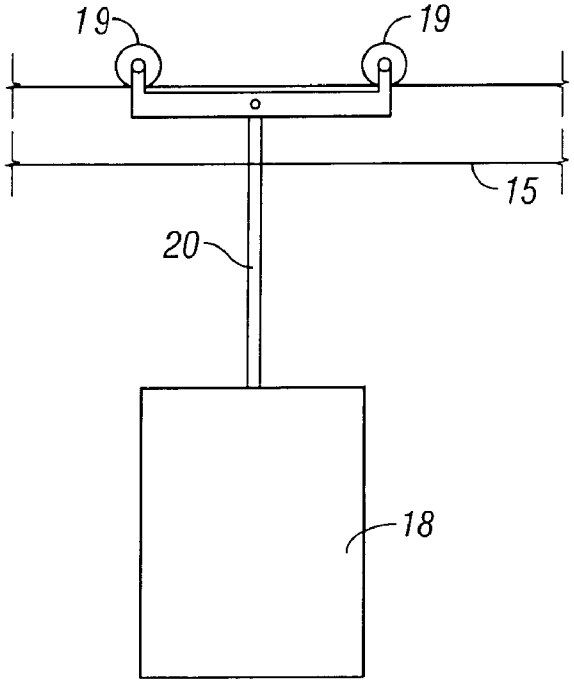
FIG. 3 shows a side view of a transporting means.

Referring to FIGS. 1–3 of the drawings, a jump cavity 2 is shown as a naturally occurring gorge between hills 3 and 4. A primary cable 5 is anchored between hills 3 and 4 by known means, spanning the gorge. A jumping platform 6 (FIG. 2) is mounted on the primary cable 5 using support wheels 7 of known type. The jumping platform 6 normally is clamped in position (using known means) but can be moved along the primary cable 5 if necessary for maintenance or repair or because of the risk of high winds.

Figure 2A:
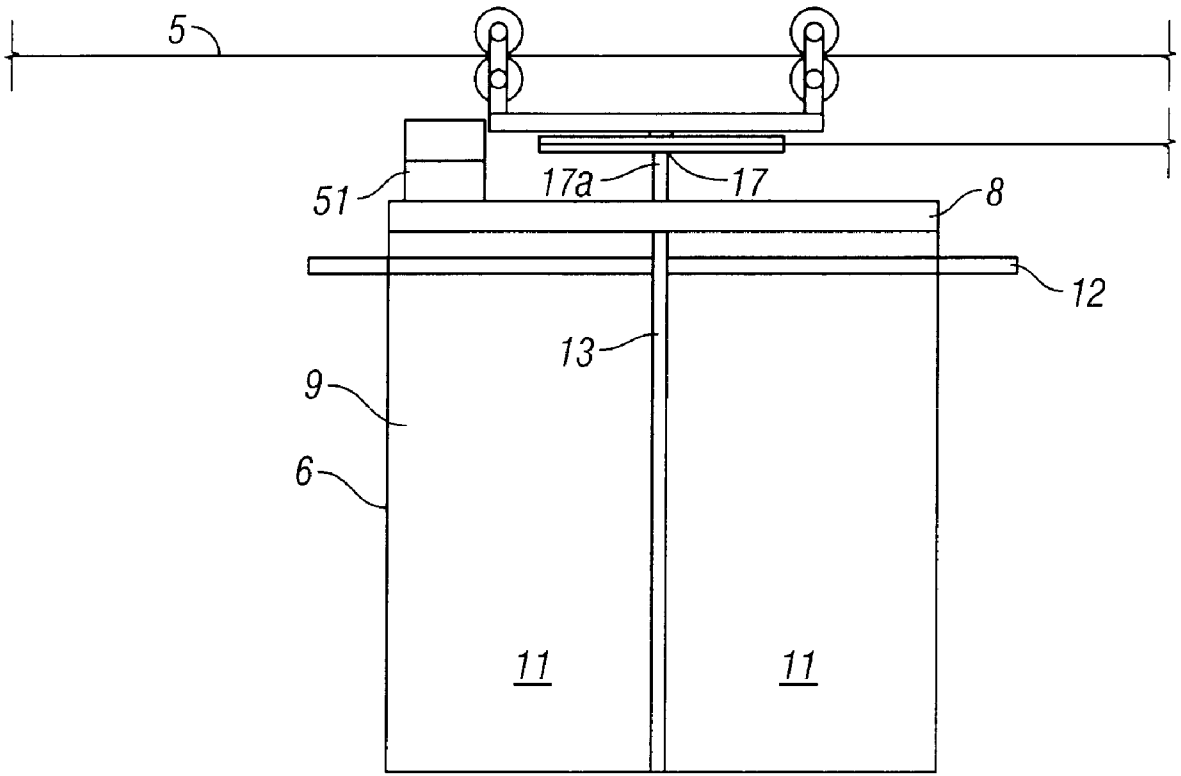
FIG. 2*a* shows a variant on FIG. 2.

The jumping platform 6 provides a roof 8, side walls 9 and a floor 10. The lower parts of the walls 9 are partially cut away to provide four spaced exit positions 11, from which jumpers can jump. A lift beam 12 for mounting a recovery winch is rigidly secured to the main support post 13. The support post 13 is secured at one end to the floor 10 and the other end to the support bracket 7*a* for the mounting wheels 7. The support post 13 also supports a pair of guide wheels 14 mounted just below the support bracket 7*a*. The guide wheels 14 receive between them an endless drive cable 15 which runs as a loop between a driving bull wheel 16 mounted at one edge of the jump cavity and a guide bull wheel 17. The bull wheel 17 is supported from the primary cable 5 on the far side of the jumping platform 6 from the driving bull wheel 16. The bull wheel 17 is supported from a bracket 17*a* which is clamped to the primary cable 5 in known manner. FIG. 2*a* shows an alternative arrangement in which the guide bull wheel 17 is mounted on the roof 8 of the jumping platform 6, on an axle 17*a* secured to the roof 8.

FIG. 3 shows a transporting means in the form of an access gondola 18. The gondola 18 is supported from the primary cable 5 by wheels 19 and is moved along the primary cable by the drive cable 15 which is secured to the support strut 20 of the gondola.

The above described apparatus is used as follows:—the jumping platform 6 is secured in position on the primary cable 5. The gondola 18 is moved by the drive cable 15 over to the hill 4, and jumpers enter the gondola at that position and are ferried out to the jumping platform 6. The gondola is temporarily secured to the jumping platform 6 (for example by means of a gang plank locked between the gondola and the jumping platform) and the jumpers move across from the gondola to the jumping platform. Each jumper in turn carries out his or her bungy jump, and is hauled back up to the jumping platform or lowered to the ground, in known manner. When all of the jumpers have completed their jumps, they are taken back to the hill 4 in the gondola or collected from the ground landing area, as appropriate. More jumpers can then be loaded into the gondola, and the sequence repeated.

Figure 4:
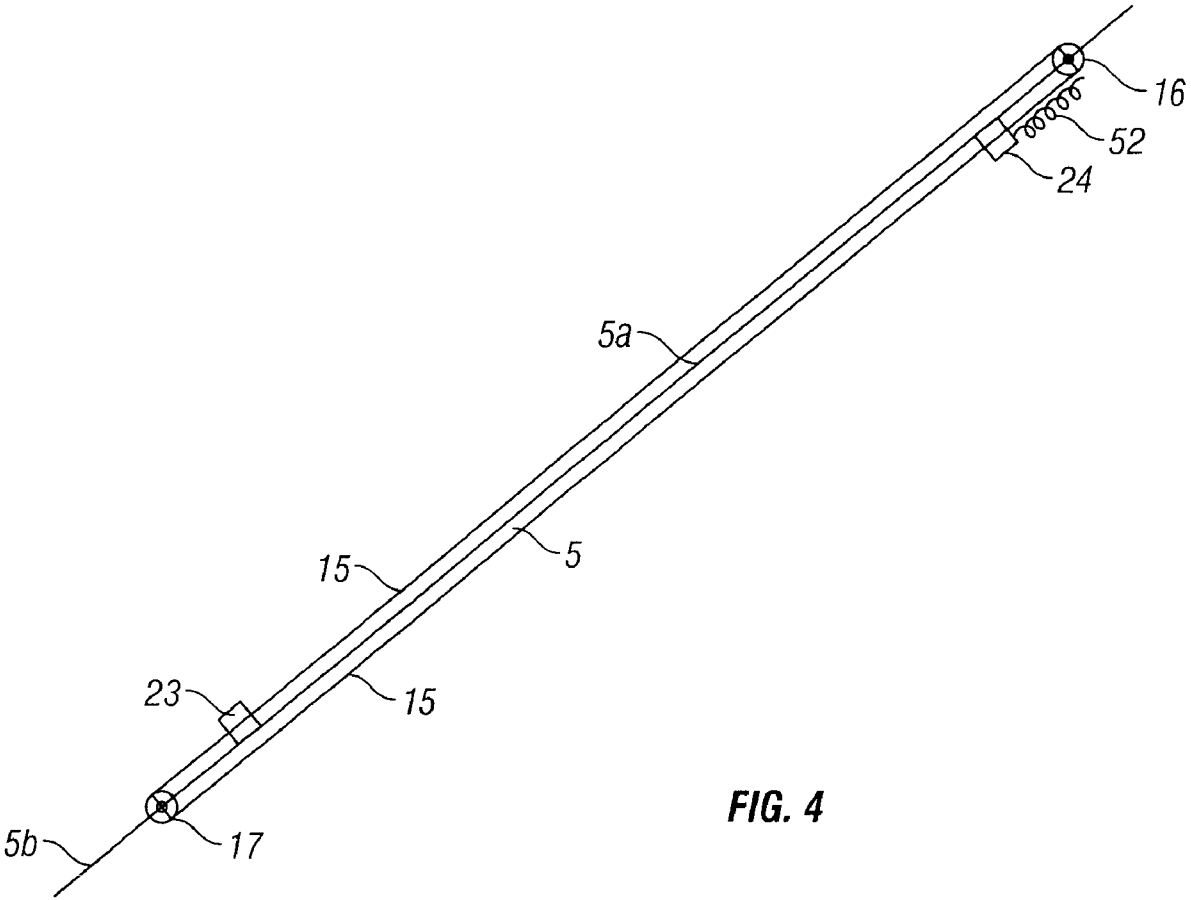
FIG. 4 shows a diagrammatic plan view of a second embodiment of the present invention.
Figure 5:
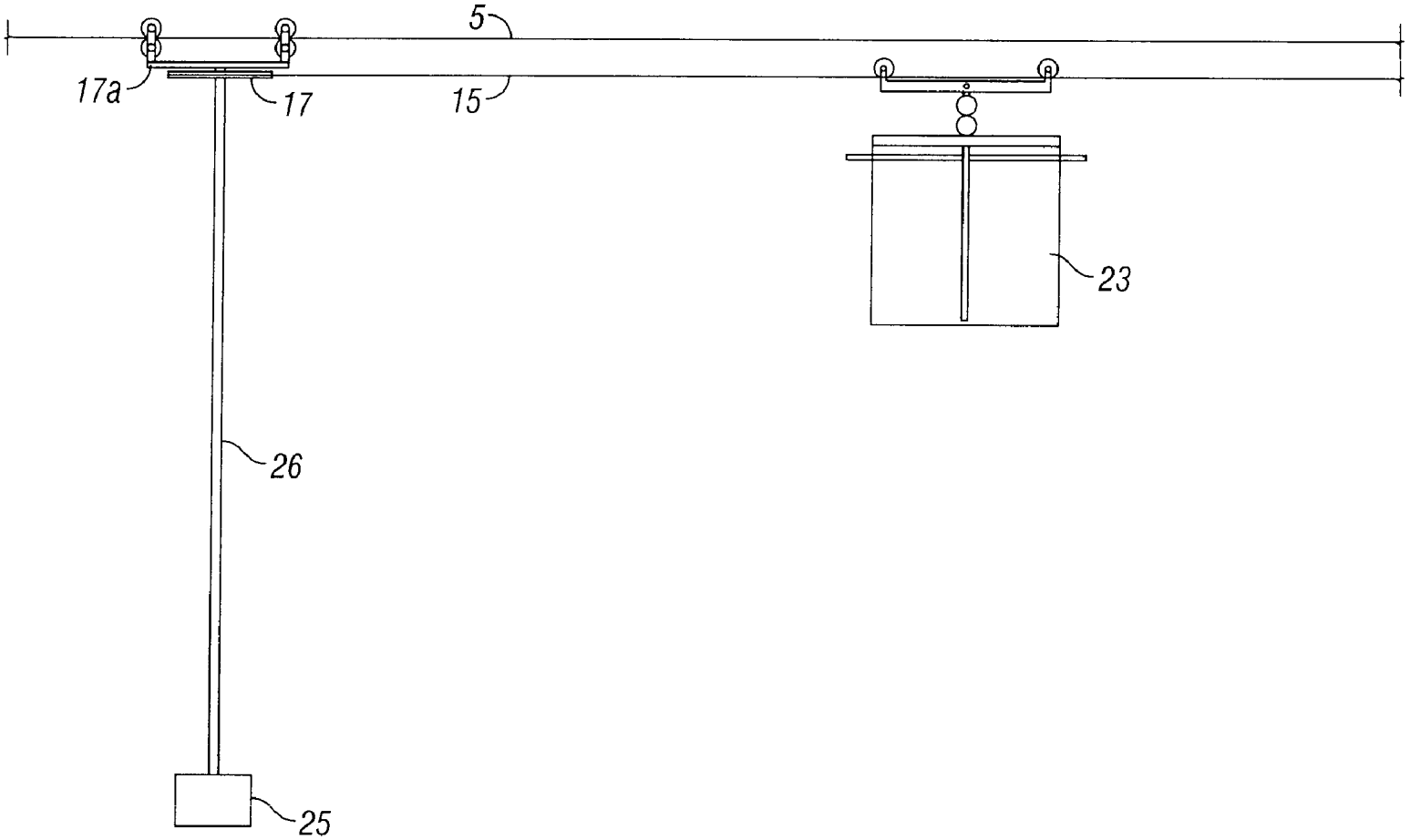
FIG. 5 shows a side view of part of the apparatus of FIG. 4, on a larger scale.

Referring to FIGS. 4 and 5, components similar to components in FIGS. 1–3 are given the same reference numerals. The primary cable 5, drive cable 15 and bull wheels 16 and 17 are mounted as described with reference to FIGS. 1–3. However, instead of a single fixed jumping platform and a transport gondola, two mobile jumping platforms which also function as transporting means, are used.

Each of the mobile jumping platforms, 23, 24, is clamped to the drive cable 15 and moved with that cable. The jumping platforms 23, 24 are spaced apart on the cable 15 so that when one jumping platform is in the selected jumping position near the bull wheel 17, the other jumping platform is adjacent the hill 4 to allow jumpers to be loaded into the jumping platform. Thus, the two jumping platforms are used alternately, with one platform being loaded with jumpers whilst jumpers jump from the other platform.

The loading fluctuations on the drive cable 15 caused by the jumping platforms 23, 24 being loaded/unloaded and the jumpers jumping, can cause the bull wheel 17 to tilt out of the horizontal plane. To prevent or restrain this movement, the bull wheel 17 is provided with a pendulum counter weight 25 mounted at the lower end of a long stay 26, the other end of which is attached to the centre of the bull wheel 17. A pendulum counter weight of this type may also be used with the bull wheel shown in FIGS. 1–3. It will be appreciated that bull wheel 17 may be positioned on hill 3 if preferred; i.e. section 5*b* of the cable 5 is omitted.

Figure 5A:
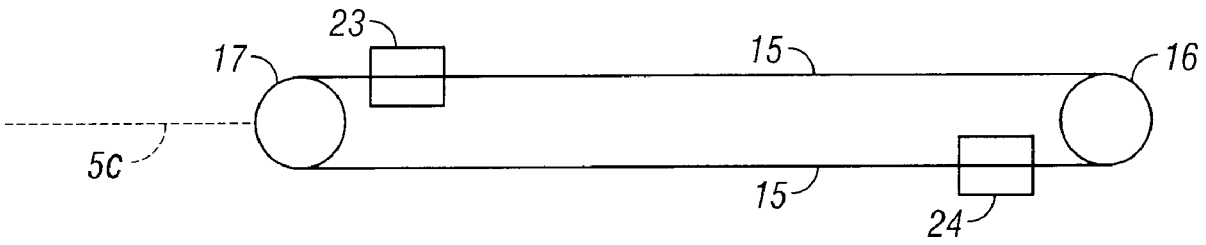
FIG. 5*a* shows a diagrammatic plan view of a variant of FIGS. 4 and 5.

The arrangement of cables shown in FIGS. 4 and 5 may be varied as shown in FIG. 5*a* by omitting the primary cable 5 and replacing the section 5*b* of the cable 5 with a further cable 5*c* (shown in broken lines) extending between the hill 3 and bull wheel 17, so that bull wheel 17 is supported on one side by the further cable 5*c* and on the other side by the cables 15.

The arrangement shown in FIG. 5*a* may be varied still further, by positioning the bull wheel 17 on hill 3 and omitting the cable 5*c* altogether. It will be appreciated that the mobile jumping platforms 23, 24 could then be used as described with reference to FIGS. 4 and 5 above, or one mobile jumping platform could be loaded from one hill 3, and the other mobile jumping platform could be loaded from the other hill 4. If the bull wheel 17 is located on land, then the pendulum counter weight is not needed.

In any of the embodiments described above, the or each loading area on the corresponding hill may be provided with a parking arrangement whereby the loading gondola 18 or the mobile jumping platform 23, 24, on approaching the parking area is disconnected from the drive cable (if separate from the supporting cable) and lifted off the supporting cable by a hinged guide rail and is supported in the parking area by independent support means. The loaded gondola or mobile jumping platform is then lifted back onto the supporting cable to be taken to the jump zone as described above.

Figure 6:
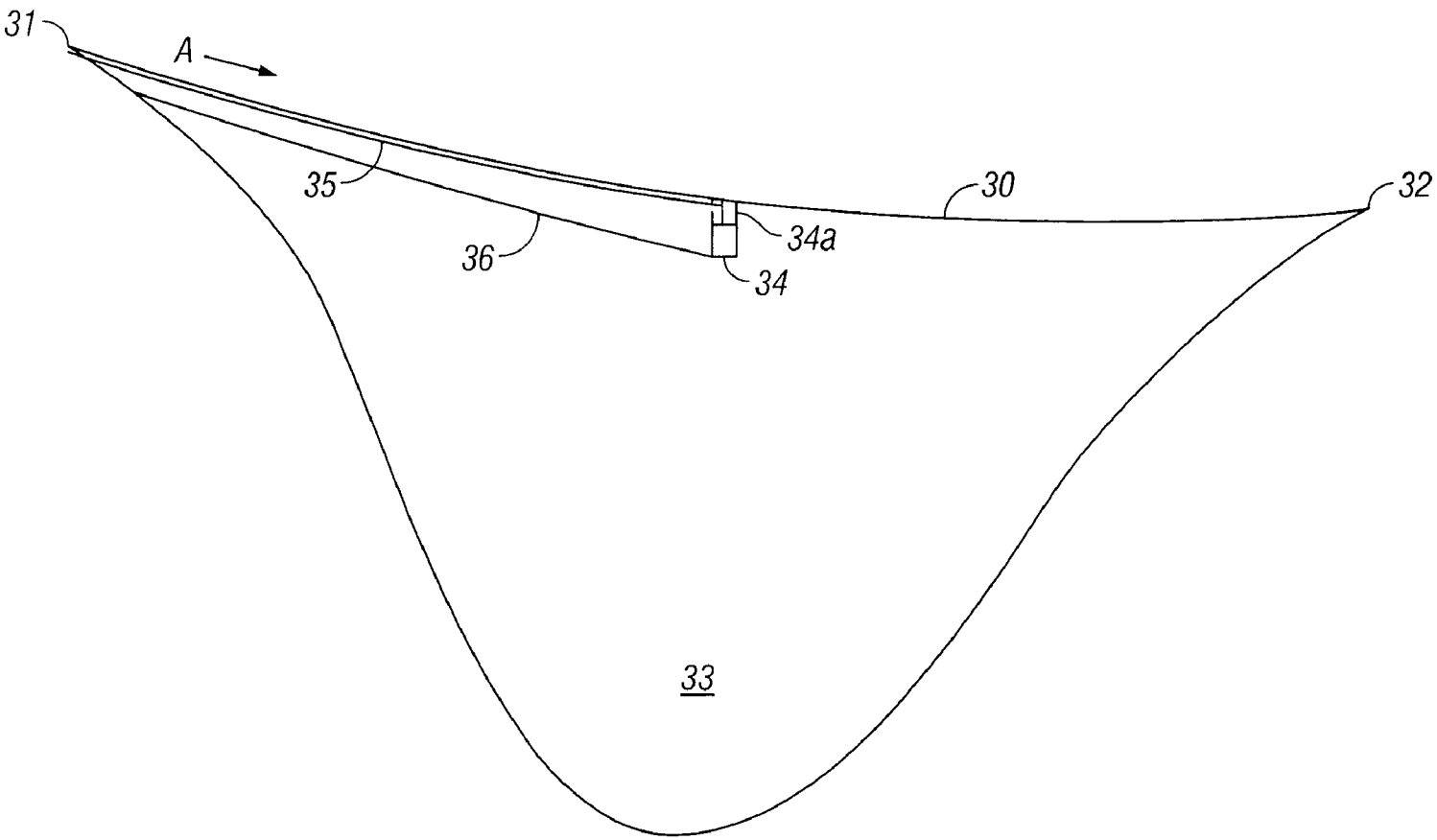
FIG. 6 shows a diagrammatic cross-section through a jump cavity and the apparatus of a third embodiment of the present invention.

FIG. 6 shows the simplest possible system, using minimal apparatus. In this embodiment, only a single cable 30 is used, supported between hills 31 and 32 on each side of a jump cavity 33. Either one of the hills (31) is higher than the other, as shown, or the cable 30 is strung loosely so as to sag in the middle. A mobile jumping platform 34 in the form of an un-powered conveyance such as a boson's chair or gondola or flying fox travels under gravity down the cable 30 from the higher hill 31 to a selected point on the cable, and is then clamped to the cable by known means whilst the person or persons on the jumping platform complete their jumps and either are released from the bungy adjacent the bottom of the jump cavity or are hauled back up to the jumping platform. The jumping platform is then pulled back to the hill 31 by means of a retrieval rope 35. Alternatively, the jumping platform 34 could be semi-permanently fixed in position over the jump cavity and jumpers could travel out to the jumping platform by means of a walkway 36. Another possibility is for the jumping platform 34 to be independently powered e.g. via a small motor and driving wheels indicated by reference numerals 34*a* in FIG. 6.

Figure 7:
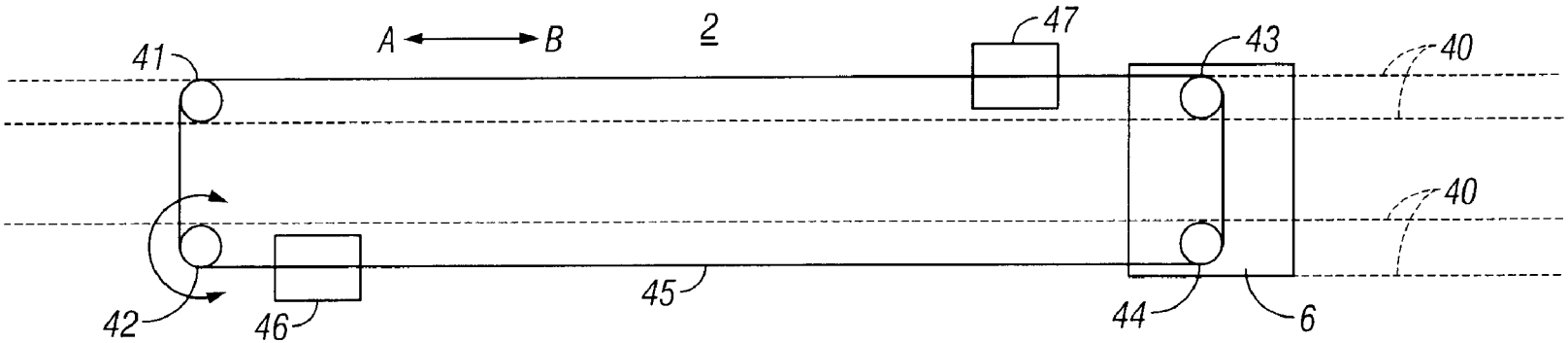
FIG. 7 shows a diagrammatic plan view of a fourth embodiment of the present invention.

FIG. 7 shows a further embodiment, in which a jumping platform 6 is mounted upon four parallel primary cables 40 which are anchored across a jump cavity 2 in known manner. The jumping platform 6 is semi-permanently mounted in position at the desired jumping position above the jump cavity 2, but can be moved along the primary cables 40 if necessary for maintenance or safety.

A pair of spaced powered bull wheels 41, 42 is mounted at one side of the jump cavity 2 and a further pair of spaced guide bull wheels 43, 44 is mounted on the roof of the jumping platform 6. An endless drive cable 45 passes around both pairs of bull wheels and can be driven in either direction, as indicated by arrows A and B, by driving the bull wheels 41, 42 in the required direction.

A transporting means in the form of an access gondola 46 is secured at a fixed position on the drive cable 45, and a counter weight 47 having approximately the same weight as the loaded gondola 46 also is secured to the drive cable 45, at a fixed position diagonally opposite the gondola 46. Jumpers are loaded onto the gondola 46 with the gondola 46 approximately positioned as shown in FIG. 7, and the drive cable 45 is driven by the bull wheels 41 and 42 in the direction of Arrow B to move the gondola 46 out across the jump cavity 2 to the jumping platform 6. The jumpers then disembark from the gondola 46 onto the jumping platform 6 and complete their jumps in the usual way. When the jumps are completed, the jumpers are retrieved to the jumping platform 6, embark in the gondola 46 and are carried back to the landing area adjacent the bull wheels 41 and 42, by driving the drive cable 45 in the direction indicated by Arrow A. The counter weight 47 moves with the drive cable 45, balancing the weight of the gondola 46 as the drive cable 45 is reciprocated.

In general, with most of the above described embodiments, it is necessary to supply power to the jumping platform. The power supply to a stationary jumping platform may be by a permanent fixed power cable 50 (FIG. 1 only). The power supply to a mobile jumping platform may be by means of a reeved cable 52 (FIG. 4 only) between the platform and the adjacent hill. If the system includes a continuously moving drive cable, it is possible to use this cable to generate power either mechanically or by a generator 51 as indicated diagrammatically in FIG. 2.

What is claimed is:

1. A bungy jumping apparatus comprising:

one or more cables, said cables being mutually substantially parallel if two or more cables are present;

means for securing the cable or each of the cables above a jump cavity such that one cable or two or more cables in combination extends across the cavity;

a jumping platform supported upon one of the cables, the jumping platform being securable in a predetermined position on the one cable;

at least one bungy securable to the jumping platform; and, transporting means for transporting one or more jumpers from adjacent an edge of the cavity to a selected position above the cavity.

2. The apparatus of claim 1 wherein the one or more cables comprise a primary cable and a secondary cable, both extending across the jump cavity, and the secondary cable comprising a drive cable formed as an endless loop.

3. The apparatus of claim 2 wherein the jumping platform is supported upon the primary cable.

4. The apparatus of claim 3 wherein the jumping platform is releasably fixed in position on the primary cable.

5. The apparatus of claim 3 wherein the transporting means is supported upon the primary cable.

6. The apparatus of claim 5 wherein the transporting means is powered independently of the one or more cables.

7. The apparatus of claim 3 wherein the transporting means comprises a gondola.

8. The apparatus of claim 3 wherein the transporting means comprises a walkway supported from the primary cable.

9. The apparatus of claim 3 wherein the transporting means comprises a boson's chair or a flying fox.

10. The apparatus of claim 2 wherein the jumping platform and the transporting means are supported upon the primary cable and the transporting means is powered by the drive cable.

11. The apparatus of claim 10 wherein the transporting means comprises a gondola.

12. The apparatus of claim 2 wherein the jumping platform is supported upon the drive cable and also forms the transporting means.

13. The apparatus of claim 12 further comprising a second jumping platform supported upon the drive cable, the first and second jumping platforms being supported upon the drive cable at positions spaced apart from each other.

14. The apparatus of claim 13 wherein the first and second jumping platforms are positioned upon the drive cable such that the first jumping platform may be positioned adjacent one side of the jump cavity when the second jumping platform is positioned suitably for jumpers to jump into the jump cavity.

15. The apparatus of claim 2 wherein the drive cable comprises an endless loop of cable running around spaced apart bull wheels with at least one of the bull wheels being driveable.

16. The apparatus of claim 2 wherein the jumping platform is supported upon the drive cable and also forms the transporting means and the drive cable comprises an endless loop of cable running around spaced apart bull wheels with at least one of the bull wheels being driveable.

17. The apparatus of claim 16 further comprising a second jumping platform supported upon the drive cable, the first and second jumping platforms being supported upon the drive cable at positions spaced apart from each other.

18. The apparatus of claim 2 wherein the jump cavity has a first side and a second side, the drive cable comprises an endless loop of cable running around spaced apart bull wheels with at least one of the bull wheels being driveable, and one of the bull wheels being supported from the ground adjacent the first side of the jump cavity and another of the bull wheels being supported from the ground adjacent the second side of the jump cavity.

19. The apparatus of claim 2 wherein the jumping platform is mobile.

20. The apparatus of claim 19 wherein the jumping platform further includes the transportation means.

21. The apparatus of claim 1 wherein the one or more cables comprise a primary cable, which extends across the jump cavity, and a secondary cable having a drive cable formed as an endless loop extending from a side of the jump cavity to a selected point part way along the primary cable.

22. The apparatus of claim 21 wherein the jump cavity has a first side and a second side, the drive cable comprises an endless loop of cable running around spaced apart bull wheels with at least one of the bull wheels being driveable, and one of the bull wheels being supported from the ground adjacent the first side of the jump cavity and another of the bull wheels being supported from the primary cable.

23. The apparatus of claim 22 wherein the jumping platform has a roof and the another of the bull wheels being supported from the primary cable is secured to the roof of the jumping platform.

24. The apparatus of claim 22 wherein the another of the bull wheels being supported from the primary cable is provided with a counter weight in the form of a pendulum secured to and suspended beneath this bull wheel.

25. The apparatus of claim 21 wherein the jumping platform is supported upon the primary cable.

26. The apparatus of claim 21 wherein the jumping platform and the transporting means are supported upon the primary cable and the transporting means is powered by the drive cable.

27. The apparatus of claim 21 wherein the jumping platform is supported upon the drive cable and also forms the transporting means.

28. The apparatus of claim 27 further comprising a second jumping platform supported upon the drive cable, the first and second jumping platforms being supported upon the drive cable at positions spaced apart from each other.

29. The apparatus of claim 28 wherein the first and second jumping platforms are positioned upon the drive cable such that the first jumping platform may be positioned adjacent one side of the jump cavity when the second jumping platform is positioned suitably for jumpers to jump into the jump cavity.

30. The apparatus of claim 28 wherein the first and second jumping platforms are positioned upon the drive cable such that the first jumping platform may be positioned adjacent one side of the jump cavity when the second jumping platform is positioned suitably for jumpers to jump into the jump cavity.

31. The apparatus of claim 21 wherein the drive cable comprises an endless loop of cable running around spaced apart bull wheels with at least one of the bull wheels being driveable.

32. The apparatus of claim 21 wherein the jumping platform is supported upon the drive cable and also forms the transporting means and the drive cable comprises an endless loop of cable running around spaced apart bull wheels with at least one of the bull wheels being driveable.

33. The apparatus of claim 21 wherein the jumping platform is mobile.

34. The apparatus of claim 33 wherein the jumping platform further includes the transporting means.

35. The apparatus of claim 1 wherein the one or more cables comprise a single primary cable extending across the jump cavity.

36. The apparatus of claim 35 wherein the jumping platform is mobile, provides the transporting means, and comprises an un-powered conveyance adapted to travel to a jumping position along the cable by gravity and to return to a start position adjacent a side of the jump cavity by use of a retrieval rope connected thereto.

37. The apparatus of claim 35 wherein the un-powered conveyance comprises a gondola, a boson's chair, or a flying fox.

38. The apparatus of claim 35 wherein the jumping platform is mobile.

39. The apparatus of claim 38 wherein the jumping platform further includes the transporting means.

40. The apparatus of claim 1 wherein the one or more cables comprise a drive cable formed as an endless loop.

41. The apparatus of claim 40 wherein the jumping platform is supported upon the drive cable and also forms the transporting means.

42. The apparatus of claim 41 further comprising a second jumping platform supported upon the drive cable, the first and second jumping platforms being supported upon the drive cable at positions spaced apart from each other.

43. The apparatus of claim 42 wherein the first and second jumping platforms are positioned upon the drive cable such that the first jumping platform may be positioned adjacent one side of the jump cavity when the second jumping platform is positioned suitably for jumpers to jump into the jump cavity.

44. The apparatus of claim 40 wherein the drive cable comprises an endless loop of cable running around spaced apart bull wheels with at least one of the bull wheels being driveable.

45. The apparatus of claim 40 wherein the jumping platform is supported upon the drive cable and also forms the transporting means and the drive cable comprises an endless loop of cable running around spaced apart bull wheels with at least one of the bull wheels being driveable.

46. The apparatus of claim 40 wherein the jump cavity has a first side and a second side, the drive cable comprises an endless loop of cable running around spaced apart bull wheels with at least one of the bull wheels being driveable, and one of the bull wheels being supported from the ground adjacent the first side of the jump cavity and another of the bull wheels being supported from the ground adjacent the second side of the jump cavity.

47. The apparatus of claim 40 wherein the jumping platform is mobile.

48. The apparatus of claim 47 wherein the jumping platform further includes the transporting means.

49. The apparatus of claim 1 wherein the jump cavity has a first side and a second side and the one or more cables comprise a drive cable formed as an endless loop extending from a first side of the jump cavity to a point part way across the jump cavity, and further including a further cable secured between the drive cable and the second side of the jump cavity.

50. The apparatus of claim 49 wherein the drive cable comprises an endless loop of cable running around spaced apart bull wheels with at least one of the bull wheels being driveable, and one of the bull wheels being supported from the ground adjacent a side of the jump cavity and another of the bull wheels being secured to the further cable.

51. The apparatus of claim 49 wherein the jumping platform is supported upon the drive cable and also forms the transporting means.

52. The apparatus of claim 51 further comprising a second jumping platform supported upon the drive cable, the first and second jumping platforms being supported upon the drive cable at positions spaced apart from each other.

53. The apparatus of claim 49 wherein the drive cable comprises an endless loop of cable running around spaced apart bull wheels with at least one of the bull wheels being driveable.

54. The apparatus of claim 49 wherein the jumping platform is supported upon the drive cable and also forms the transporting means and the drive cable comprises an endless loop of cable running around spaced apart bull wheels with at least one of the bull wheels being driveable.

55. The apparatus of claim 49 wherein the jumping platform is mobile.

56. The apparatus of claim 55 wherein the jumping platform further includes the transportation means.

57. The apparatus of claim 1 wherein the jumping platform is mobile.

58. The apparatus of claim 57 wherein the jumping platform further includes the transporting means.

* * * * *